US007871138B2

(12) United States Patent
Anikhindi et al.

(10) Patent No.: US 7,871,138 B2
(45) Date of Patent: Jan. 18, 2011

(54) VERTICAL LIFT DOOR ASSEMBLY FOR AN APPLIANCE

(75) Inventors: Sanjay Manohar Anikhindi, Karnataka (IN); David Joseph Najewicz, Prospect, KY (US); Marc Eric Hottenroth, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1301 days.

(21) Appl. No.: 11/412,248

(22) Filed: Apr. 27, 2006

(65) Prior Publication Data

US 2007/0251519 A1 Nov. 1, 2007

(51) Int. Cl.
*A47B 95/02* (2006.01)

(52) U.S. Cl. ..... 312/319.4; 49/216

(58) Field of Classification Search ... 312/319.1–319.4, 312/324, 283, 285–287, 139.2; 49/197, 201–204, 49/254, 255, 257, 259, 208–212, 221, 216
See application file for complete search history.

(56) References Cited

U.S. PATENT DOCUMENTS

| | | | | | |
|---|---|---|---|---|---|
| 2,445,131 | A | * | 7/1948 | Wartian | 49/212 |
| 2,621,097 | A | * | 12/1952 | Steinberg | 312/139.2 |
| 4,063,388 | A | | 12/1977 | Little | |
| 4,107,879 | A | | 8/1978 | Steimann | |
| 4,226,049 | A | | 10/1980 | Maust | |
| 4,337,596 | A | * | 7/1982 | Kern et al. | 49/210 |
| 4,480,408 | A | | 11/1984 | Deuman, Sr. et al. | |
| 4,702,514 | A | * | 10/1987 | Perry | 49/209 |
| 4,756,123 | A | | 7/1988 | Roche et al. | |
| 4,884,556 | A | * | 12/1989 | Alden et al. | 49/209 |
| 4,964,228 | A | * | 10/1990 | Coffman | 49/208 |
| 5,186,230 | A | | 2/1993 | Ostrander | |
| 5,261,720 | A | * | 11/1993 | Lomax et al. | 49/209 |
| 5,347,757 | A | * | 9/1994 | Losito | 49/211 |
| 5,566,508 | A | * | 10/1996 | Houston | 49/445 |
| 6,152,547 | A | | 11/2000 | Wang | |
| 6,164,014 | A | * | 12/2000 | McDowell et al. | 49/197 |
| 6,195,939 | B1 | | 3/2001 | Sowers | |
| 6,226,924 | B1 | | 5/2001 | Kuzub | |
| 6,561,256 | B2 | * | 5/2003 | Mullet | 49/200 |
| 6,600,397 | B2 | | 7/2003 | Bassi | |
| 6,691,463 | B1 | | 2/2004 | Richmond | |
| 6,766,596 | B1 | | 7/2004 | Bienick et al. | |

(Continued)

FOREIGN PATENT DOCUMENTS

| | | | | |
|---|---|---|---|---|
| DE | 3101000 | * | 12/1981 | 49/212 |

(Continued)

*Primary Examiner*—Hanh V Tran
(74) *Attorney, Agent, or Firm*—George L. Rideout, Esq.; Armstrong Teasdale LLP

(57) ABSTRACT

An appliance includes a chassis defining a cavity and having an opening for accessing the cavity and a door assembly joined to the chassis. The door assembly includes a door for closing access to the opening, and the door assembly further includes a door lift sub-assembly having a horizontal slide and a vertical slide. The door is coupled to one of the horizontal slide and the vertical slide. The horizontal slide is moveable between a recessed position and an extended position and is configured to move the door in a substantially horizontal direction. The vertical slide is moveable between a closed position and an open position and is configured to move the door in a substantially vertical direction.

17 Claims, 9 Drawing Sheets

U.S. PATENT DOCUMENTS

| | | | | |
|---|---|---|---|---|
| 7,150,071 | B2 | 12/2006 | Collene et al. | |
| 7,192,104 | B2 | 3/2007 | Tarantik | |
| 7,234,457 | B2 | 6/2007 | Bartmann et al. | |
| 2004/0093801 | A1* | 5/2004 | Robert et al. | 49/360 |
| 2005/0044799 | A1* | 3/2005 | Kinross et al. | 49/413 |

FOREIGN PATENT DOCUMENTS

| | | | | |
|---|---|---|---|---|
| JP | 01295989 | * 11/1989 | | 49/197 |
| JP | 02300492 | * 12/1990 | | 49/197 |

* cited by examiner

VERTICAL LIFT DOOR ASSEMBLY FOR AN APPLIANCE

BACKGROUND OF THE INVENTION

This invention relates generally to appliances, and more particularly, to vertical lift door assemblies for appliances.

Known appliances typically include a door for closing access to the appliance. The door is hinged along one of the edges of the door and swings open. The door therefore requires an amount of clear space at the front to allow for the door to open. Objects in front of the appliance may interfere with the opening of the door.

BRIEF DESCRIPTION OF THE INVENTION

In one aspect, an appliance is provided including a chassis defining a cavity and having an opening for accessing the cavity and a door assembly joined to the chassis. The door assembly includes a door for closing access to the opening, and the door assembly further includes a door lift sub-assembly having a horizontal slide and a vertical slide. The door is coupled to one of the horizontal slide and the vertical slide. The horizontal slide is moveable between a recessed position and an extended position and is configured to move the door in a substantially horizontal direction. The vertical slide is moveable between a closed position and an open position and is configured to move the door in a substantially vertical direction.

In another aspect, an appliance is provided including a chassis defining a cavity and having an opening for accessing the cavity and a door assembly joined to the chassis. The door assembly includes a door for closing access to the opening, and the door has a top end and a bottom end. The door assembly further includes a door lift sub-assembly coupled to the door proximate the bottom end. The door lift sub-assembly is configured to move the door in a substantially vertical direction.

In a further aspect, a door assembly is provided for an appliance. The door assembly includes a door for the appliance, a vertical slide having a vertical fixed member coupled to the appliance and a vertical movable member slidably coupled to the vertical fixed member, and a horizontal slide having a horizontal fixed member coupled to the vertical movable member and a horizontal movable member slidably coupled to the horizontal fixed member and to the door. The horizontal slide is configured to move the door in a substantially horizontal direction and the vertical slide configured to move the door in a substantially vertical direction.

DETAILED DESCRIPTION OF THE INVENTION

Figure 1:
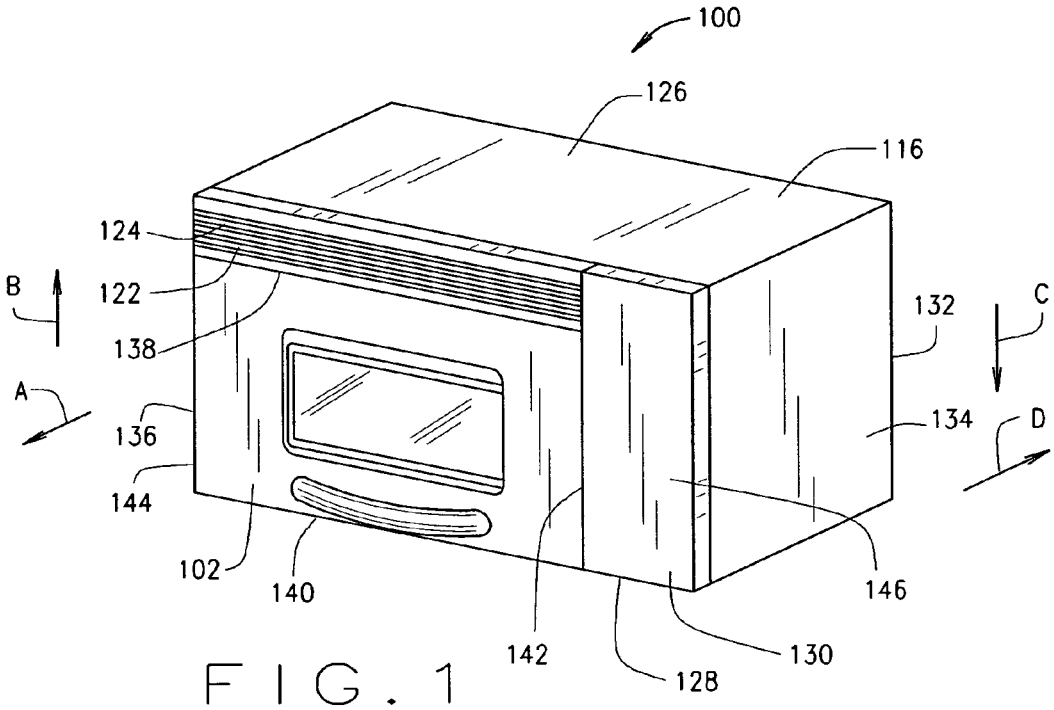
FIG. 1 illustrates an exemplary appliance with a door in a closed position.
Figure 2:
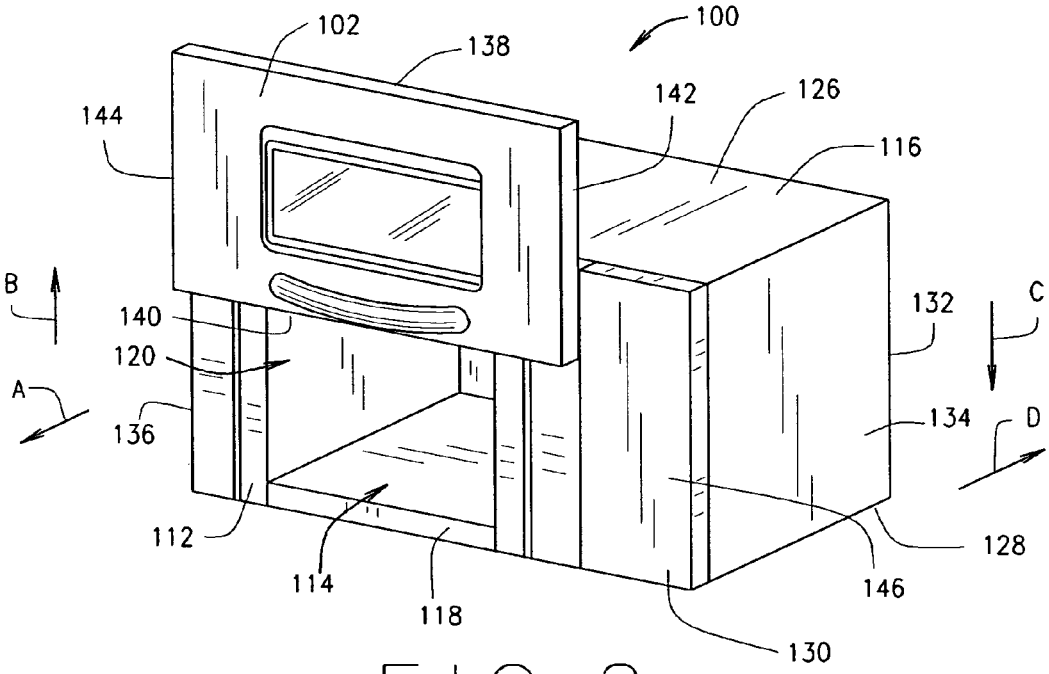
FIG. 2 illustrates the appliance shown in FIG. 1 with the door in an open position.

FIG. 1 illustrates an exemplary appliance 100 with a door 102 in a closed position. FIG. 2 illustrates appliance 100 with door 102 in an open position. In the illustrated embodiment, appliance 100 is an oven, such as an over the range microwave oven, and the various components and embodiments will be described in terms of oven 100. However, it is contemplated that the various components and embodiments are applicable, not only to over the range microwave ovens which are installed above a cooking apparatus, such as a gas range (not shown), but to other forms of appliances as well, such as, but not limited to, free standing microwave ovens, ranges, front loading laundry washers and dryers, dish washers, refrigerators, freezers, and the like. Therefore, oven 100 is provided by way of illustration rather than limitation.

Turning to FIGS. 1 and 2, oven 100 includes a main body or chassis 112 defining a cavity 114 therein. Chassis 112 supports a housing 116 surrounding cavity 114. A front edge 118 of chassis 112 surrounds an opening 120 that provides access to cavity 114. Door 102 closes access to opening 120 and cavity 114. In the exemplary embodiment, cavity 114 is surrounded by a plurality of side walls (not labeled), and the side walls are made of heat insulation material. Each of the side walls includes an inner porcelain coating thereon for resisting a high temperature. Oven 100 also includes a cooling air flow channel 122 surrounding cavity 114 and cooling air flow channel 122 exhausts air through vent 124.

In the exemplary embodiment, oven 100 includes at least one heating module such as, for example, an RF generation system (e.g., a magnetron), an upper heater module, and/or a lower heater module for cooking and/or heating items placed in cavity 114. Upper and/or lower heater module includes radiant heating elements such as a ceramic heater or a halogen cooking lamp. Upper and/or lower heater module may also includes a sheath heater. Upper and/or lower heater module may include a conventional bake element, broil element, or a convection heating element. A convection fan may be provided for blowing air over heating elements and into cavity 114.

The specific heating elements and RF generation system can vary from embodiment to embodiment, and the elements and system described above are exemplary only. For example, upper heater module can include any combination of heaters including combinations of halogen lamps, ceramic lamps, and/or sheath heaters. Similarly, lower heater module can include any combination of heaters including combinations of halogen lamps, ceramic lamps, and/or sheath heaters. In addition, the heaters can all be one type of heater. The specific ratings and number of lamps and/or heaters utilized in upper heater module and lower heater module can vary from embodiment to embodiment. Generally, the combinations of lamps, heaters, and RF generation system is selected to provide the desired cooking characteristics for speedcooking, microwave, and convection/bake modes.

In the exemplary embodiment, oven 100 includes a top 126, a bottom 128, a front 130, a rear 132, a first side 134 and a second side 136. Additionally, in the exemplary embodiment, door 102 includes a door top 138, a door bottom 140, a first door side 142 and a second door side 144. Door top 138, door bottom 140, first door side 142 and second door side 144 have a similar orientation as top 126, bottom 128, first side 134 and second side 136, respectively. Opening 120 faces front 130 and door 102 is positioned along front 130. Vent 124 is positioned along front 130 proximate top 126. A control panel 146 is positioned along first side 134. Control panel 146 and vent 124 are substantially flush, and in plane with, door 102 when door 102 is in the closed position. In the exemplary embodiment, door 102 is slidably coupled to oven 100 such that door 102 moves along front 130 generally vertically upward from the closed position illustrated in FIG. 1 to the open position illustrated in FIG. 2. Alternatively, door 102 moves generally vertically downward.

During operation, when door 102 is in the closed position, door 102 is moved horizontally outward, such as in the direction of arrow A, for a distance. The distance is selected such that door 102 clears obstructions vertically above door 102, such as, for example, vent 124. Once extended horizontally, door 102 is lifted vertically upward, such as in the direction of arrow B, to the open position illustrated in FIG. 2. When opened, a user may access cavity 114. To close door 102, door 102 is pulled vertically downward, such as in the direction of arrow C to a lowermost position, and then door is pushed horizontally inward toward cavity 114, such as in the direction of arrow D to the closed position illustrated in FIG. 1.

Figure 3:
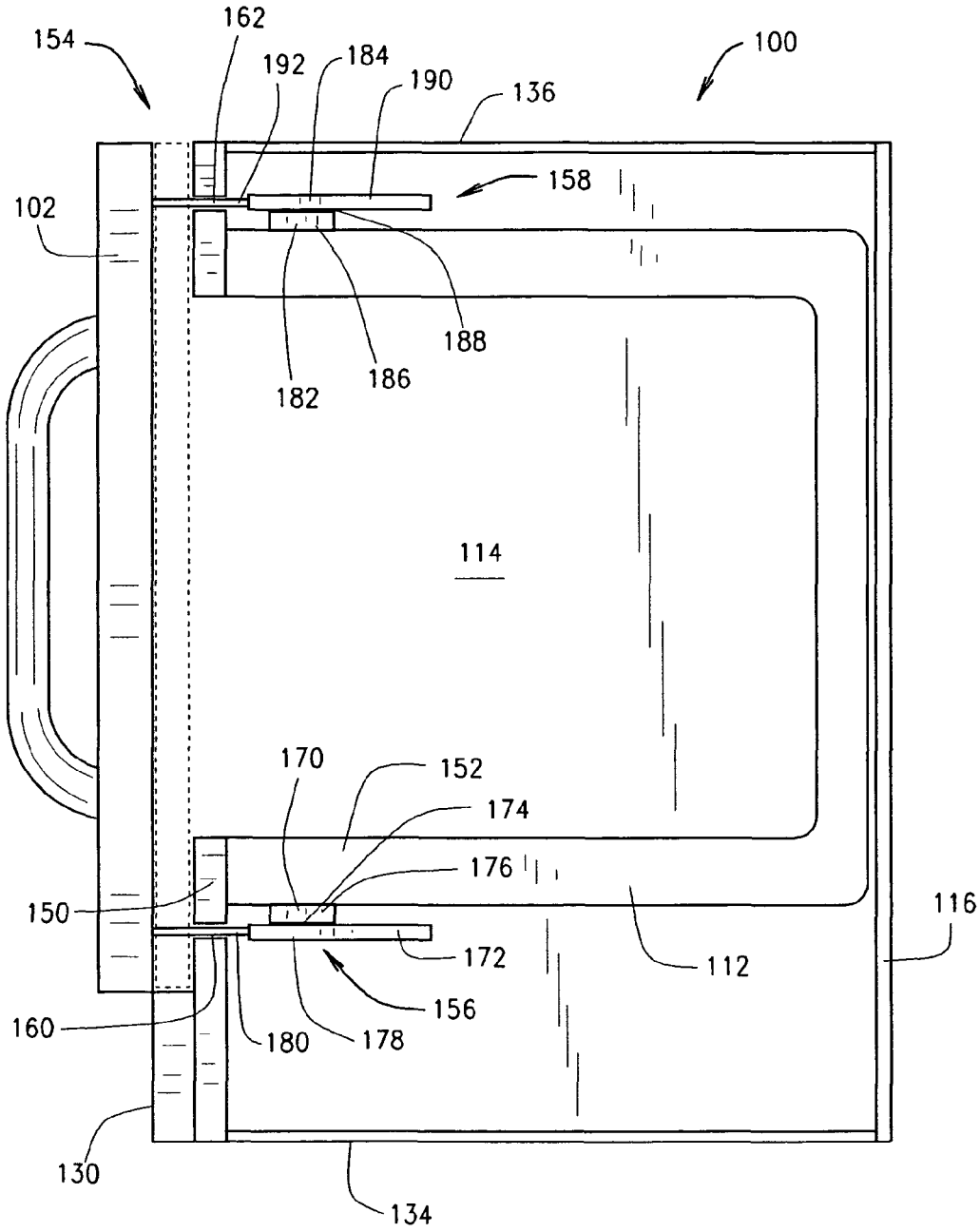
FIG. 3 illustrates a cross-sectional view of the appliance shown in FIGS. 1 and 2, showing the door in an extended position.

FIG. 3 illustrates a cross-sectional view of oven 100 showing door 102 in an extended position. In the extended position, door 102 is moved horizontally away from cavity 114 in order to clear a portion of oven (shown in phantom in FIG. 3) as door 102 is opened vertically upward. As illustrated in FIG. 3, chassis 112 includes a front frame portion 150 extending along front 130 and a cavity portion 152 defining cavity 114. Housing 116 is coupled to, and supported by, front frame portion 150.

In the exemplary embodiment, oven 100 includes a door assembly 154 joined to chassis 112. Door assembly 154 includes a first door lift sub-assembly 156 and a second door lift sub-assembly 158. First door lift sub-assembly 156 is coupled to cavity portion 152 of chassis 112 proximate first side 134 of oven 100. Second door lift sub-assembly 158 is coupled to cavity portion 152 of chassis 112 proximate second side 136 of oven 100. Each of first and second door lift sub-assemblies 156 and 158 are coupled to door 102. In the exemplary embodiment, first and second door lift sub-assemblies 156 and 158 are coupled to door 102 proximate door bottom 140 (shown in FIGS. 1 and 2). A portion of first door lift sub-assembly 156 extends through, and are movable within, a first slot 160 in front frame portion 150 and a portion of second door lift sub-assembly 158 extends through, and are movable within, a second slot 162 in front frame portion 150. Slots 160 and 162 provide access to door 102 from inside housing 116 and chassis 112. As such, the hardware of first and second door lift sub-assemblies 156 and 158 may be substantially enclosed and hidden from view from outside oven 100.

In the exemplary embodiment, first door lift sub-assembly 156 includes a first vertical slide 170 and a first horizontal slide 172. First vertical slide 170 is oriented to have more of a vertical direction of movement than a horizontal direction of movement, and first vertical slide 170 is configured to move door 102 in a substantially vertical direction. First horizontal slide 172 is oriented to have more of a horizontal direction of movement than a vertical direction of movement, and first horizontal slide 172 is configured to move door 102 in a substantially horizontal direction. In the exemplary embodiment, slides 170 and 172 operate independently from one another and singly such that only one of slides 170 and 172 are operated at a time. In the exemplary embodiment, door 102 is mounted to first horizontal slide 172. In an alternative embodiment, door 102 is mounted to a connecting device (not shown) that is coupled to first horizontal slide 172.

First vertical slide 170 includes a fixed member 174 and a movable or sliding member 176. First horizontal slide includes a fixed member 178 and a movable or sliding member 180. In the exemplary embodiment, first vertical slide fixed member 174 is fixedly mounted to chassis 112, and first vertical slide movable member 176 is slidably coupled to fixed member 174. Movable member 176 is movable between a lifted position, generally toward a top portion of fixed member 174, and a reset or resting position, generally toward a bottom portion of fixed member 174. First horizontal slide fixed member 178 is fixedly mounted to first vertical slide movable member 176, and first horizontal slide movable member 180 is slidably coupled to fixed member 178. Movable member 180 is movable between an extended position, generally toward a front portion of fixed member 178 such as in the direction of door 102, and a retracted position, generally toward a rear portion of fixed member 178 such as away from door 102.

In the exemplary embodiment, second door lift sub-assembly 158 includes a second vertical slide 182 and a second horizontal slide 184. Second vertical slide 182 is oriented to have more of a vertical direction of movement than a horizontal direction of movement, and second vertical slide 182 is configured to move door 102 in a substantially vertical direction. Second horizontal slide 184 is oriented to have more of a horizontal direction of movement than a vertical direction of movement, and second horizontal slide 184 is configured to move door 102 in a substantially horizontal direction. In the exemplary embodiment, slides 182 and 184 operate independently from one another and singly such that only one of slides 182 and 184 are operated at a time. In the exemplary embodiment, door 102 is mounted to second horizontal slide 184. In an alternative embodiment, door 102 is mounted to a connecting device (not shown) that is coupled to second horizontal slide 184.

Second vertical slide 182 includes a fixed member 186 and a movable or sliding member 188. Second horizontal slide 184 includes a fixed member 190 and a movable or sliding member 192. In the exemplary embodiment, second vertical slide fixed member 186 is fixedly mounted to chassis 112, and second vertical slide movable member 188 is slidably coupled to fixed member 186. Movable member 188 is movable between a lifted position, generally toward a top portion of fixed member 186, and a reset or resting position, generally toward a bottom portion of fixed member 186. Second horizontal slide fixed member 190 is fixedly mounted to second vertical slide movable member 188, and second horizontal slide movable member 192 is slidably coupled to fixed member 190. Movable member 192 is movable between an extended position, generally toward a front portion of fixed member 190 such as in the direction of door 102, and a retracted position, generally toward a rear portion of fixed member 190 such as away from door 102.

Figure 4:
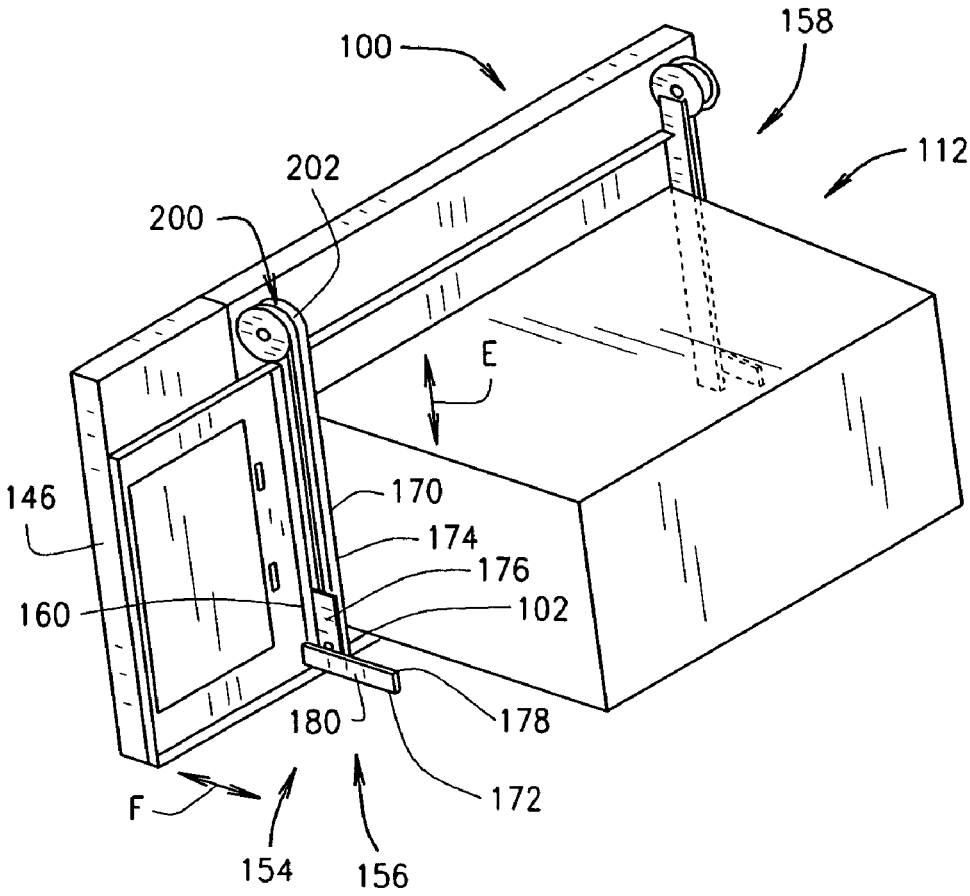
FIG. 4 illustrates a portion of the appliance shown in FIGS. 1 and 2, showing an exemplary door assembly for the appliance.

FIG. 4 illustrates a portion of oven 100 with housing 116 removed for clarity and showing door assembly 154. First door lift sub-assembly 156 is mounted to chassis 112 proximate first side 134 of oven 100 and second door lift sub-assembly 158 is mounted to chassis 112 proximate second side 136 of oven. The description of FIG. 4 will be described with reference to the features and operation of first door lift sub-assembly 156 with the understanding that second door lift sub-assembly 158 includes similar features and operates in a similar manner.

In the illustrated embodiment, vertical slide fixed member 174 is coupled to chassis 112. Vertical slide movable member 176 is slidable in a vertical direction along fixed member 174, such as in the direction of arrow E. Notably, movable member 176 slides upward as door 102 is opened and movable member 176 slides downward as door 102 is closed. In an alternative embodiment, door 102 opens downward, in which case, movable member 176 slides downward as door 102 is opened and upward as door 102 is closed.

Horizontal slide fixed member 178 is mounted to vertical slide movable member 176. As such, horizontal slide 172 is simultaneously movable in a vertical direction with vertical slide movable member 176. In the exemplary embodiment, horizontal slide 172 is oriented orthogonally with respect to vertical slide 170. Horizontal. slide movable member 180 is slidable in a horizontal direction along fixed member 178, such as in the direction of arrow F. As indicated above, a portion of horizontal slide 172 extends through first slot 160. In the exemplary embodiment, horizontal slide movable member 180 extends through slot 160. In the illustrated embodiment, slot 160 is elongated in the vertical direction and extends parallel to vertical slide 170. As such, as door 102 is either opened or closed, horizontal slide 172 is moved vertically within slot 160.

In the exemplary embodiment, door assembly 154 includes a counter-balance sub-assembly 200 to facilitate aiding a user in lifting door 102 to the open position and to provide resistance to door 102 closing prematurely or too quickly. For example, in the exemplary embodiment, counter-balance sub-assembly 200 includes a spring member 202, such as, but not limited to, a roll-up type or a spiral-type constant torsion spring, coupled to either horizontal slide 172 or vertical slide movable member 176. Spring member 202 provides a upward pulling force on horizontal slide 172 or vertical slide movable member 176 to aide in opening door 102. Spring member 202 is positioned to provide a tension on door 102 throughout the range of motion of door 102. In the exemplary embodiment, the length of spring member 202 is substantially longer than the distance of travel of door 102 to minimize the change in force over the range of motion of door 102 and provide a constant tension force on door 102. In an alternative embodiment, counter-balance sub-assembly 200 is replaced by a motor operating to lift door 102. The motor may be operated by a switch on control panel 146. In one embodiment, the motor includes a drive screw to drive the vertical slide 170 up and down. Alternatively, the motor winds or unwinds a coil or spool of material to raise or lower door 102. The motor may operate at a constant speed or may operate at a variable speed. In another alternative embodiment, counter-balance sub-assembly 200 includes a counterbalance weight that is movable to aid in the opening and closing of door 102.

Figure 5:
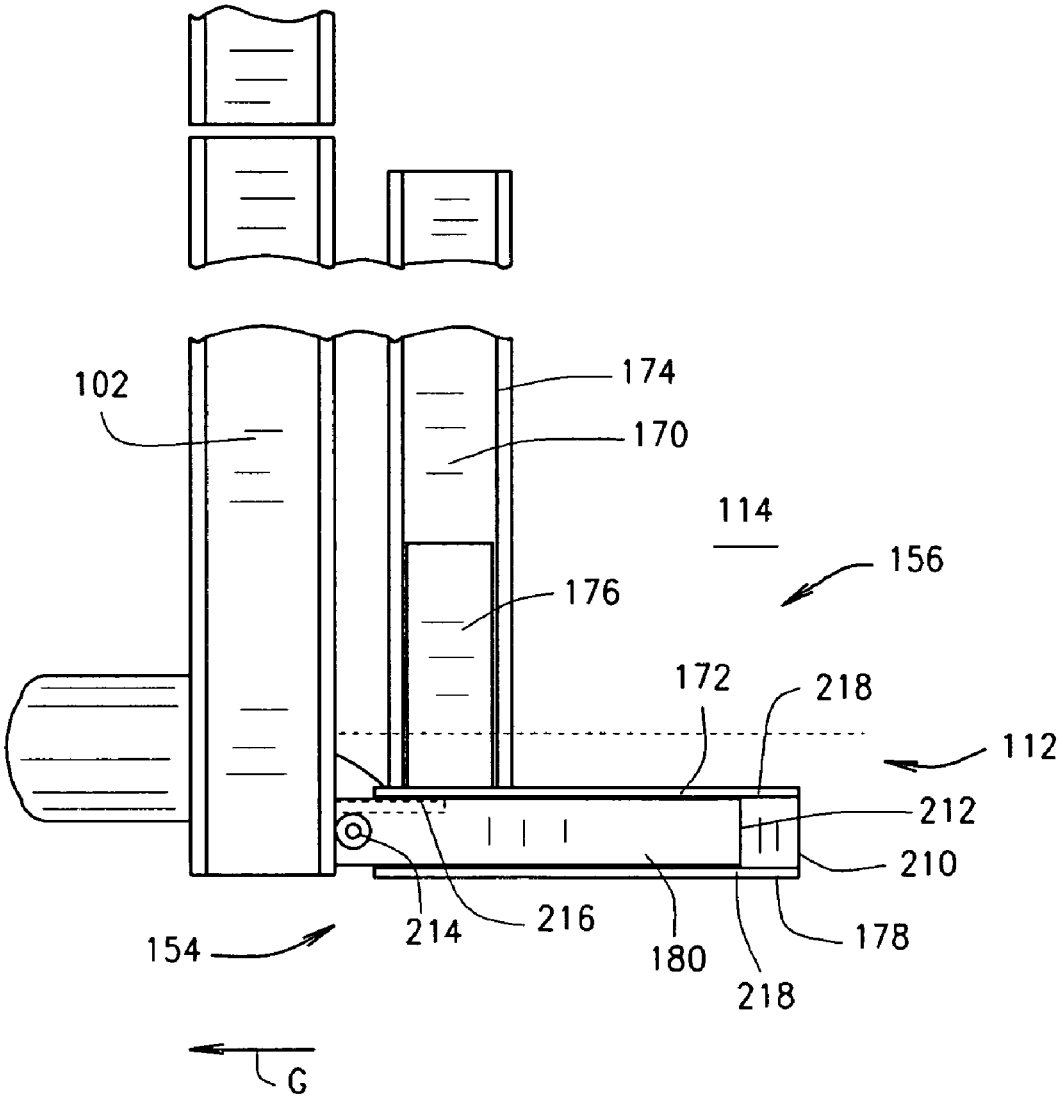
FIG. 5 illustrates the door assembly shown in FIG. 4 in a retracted position.
Figure 6:
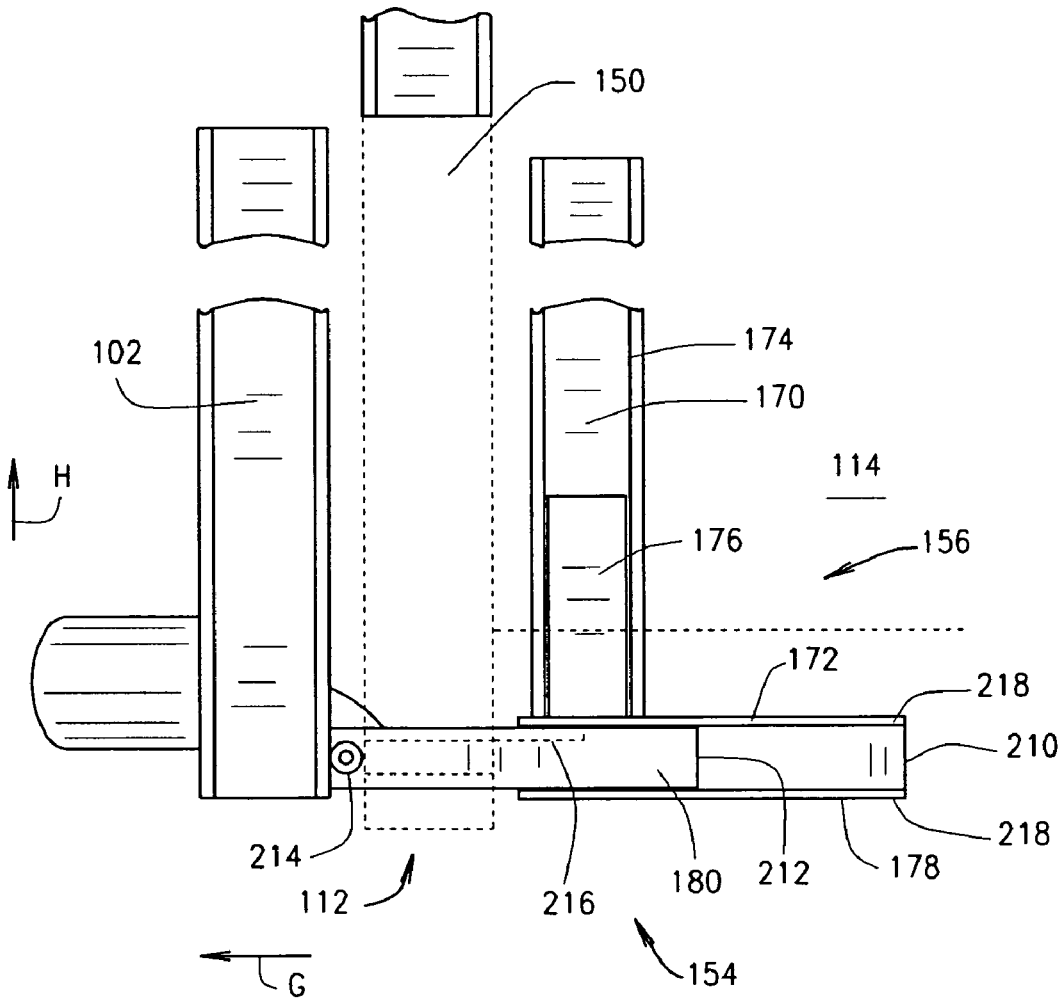
FIG. 6 illustrates the door assembly shown in FIG. 4 in an extended position.
Figure 7:
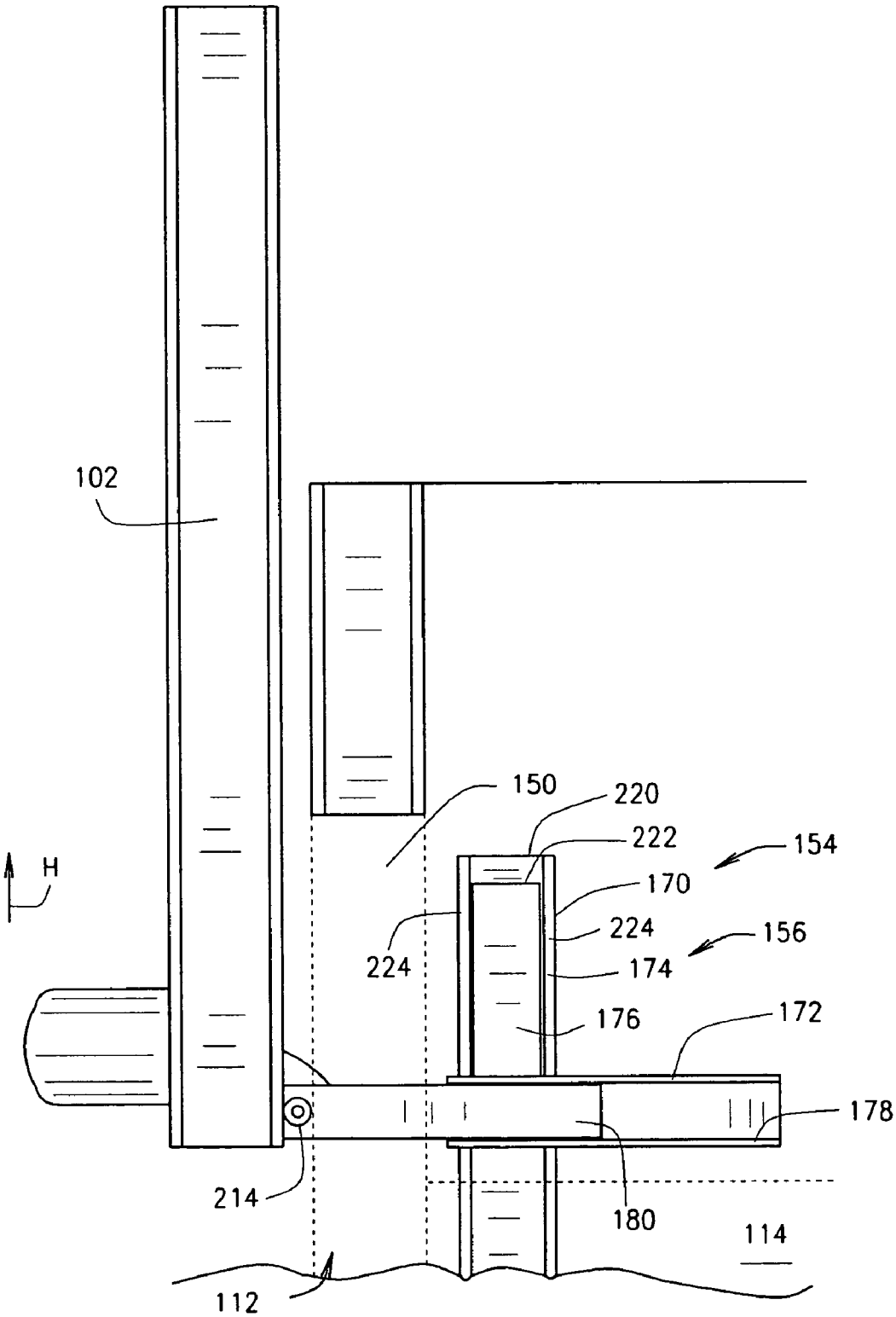
FIG. 7 illustrates the door assembly shown in FIG. 4 in an open position.

An exemplary opening operation of door 102 is described below with reference to FIGS. 5-7. However, it is contemplated that other opening operations are applicable to door 102. FIG. 5 illustrates door 102 and door assembly 154 in a retracted and closed position. FIG. 6 illustrates door 102 and door assembly 154 in an extended and closed position, in that door still restricts access to cavity 114 (shown in FIG. 3) even though door is not sealed or immediately adjacent front frame portion 150 of chassis 112 (shown partially in phantom). FIG. 7 illustrates door 102 and door assembly 154 in an open position wherein cavity 114 is accessible. Thus, the opened and closed positions refer to a vertical position of door 102 with respect to front frame portion 150 and the extended and retracted positions refer to a horizontal position of door 102 with respect to front frame portion 150.

Turning to FIG. 5, in the retracted and closed position, door 102 is substantially aligned with and adjacent front frame portion 150 of chassis 112 and closes access to cavity 114. In the exemplary embodiment, oven 100 includes an interlock for locking door 102 in the retracted and closed position. The interlock is used to ensure that door 102 remains closed during operation of oven 100, and the operation of oven stops when door is no longer in the retracted position, such as when a user opens door 102. In one embodiment, the interlock may be a latch.

In the retracted position, horizontal slide movable member 180 is in a rearward position such that a rearward end 210 of moveable member 180 is positioned proximate a rearward end 212 of horizontal fixed member 178. In the exemplary embodiment, a roller element 214 is coupled to movable member 180. Roller element 214 rotates to ease movement of door 102 between the retracted position and the extended position. In the exemplary embodiment, a ledge 216 (shown in phantom in FIGS. 5 and 6) extends inward from front frame portion 150. Ledge 216 is positioned adjacent slot 160. Roller element 214 engages ledge 216 and is guided by ledge 216 as door is moved between the retracted and extended positions. In the retracted position, roller element 214 engages ledge 216 to resist vertical movement of door 102. In the exemplary embodiment, ledge 216 is substantially horizontal.

During operation, door 102 is pulled generally horizontally outward from cavity 114, such as in the direction of arrow G, to the extended position, which is illustrated in FIG. 6. As door 102 is moved to the extended position, roller element 214 is guided along ledge 216. Additionally, horizontal movable member 180 is guided by rail portions 218 of horizontal fixed member 178. Rail portions 218 retain movable member 180 in channels. Alternatively, rail portions 218 are provided on movable member 180 and receive fixed member 178 in the channels created by rail portions 218.

In the extended and closed position, rearward end 210 of moveable member 180 is positioned remote with respect to rearward end 212 of horizontal fixed member 178. Additionally, an upward end 220 of vertical moveable member 176 is positioned remote with respect to an upward end 222 of vertical fixed member 174. In the exemplary embodiment, horizontal slide 172 includes a stop (not shown) to limit how far movable member 180 can move with respect to fixed member 178. As such, door 102 can not be pulled completely out of door lift sub-assembly 156. In the extended position, roller element 214 is substantially aligned with the front face of front frame portion 150. As door 102 is moved vertically between the closed and open positions, roller engages front frame portion 150 and guides door 102 along front frame portion 150 in a substantially vertical direction.

During operation, door 102 is lifted generally vertically upward, such as in the direction of arrow H, to the open position, which is illustrated in FIG. 7. As door 102 is moved to the open position, roller element 214 is guided along front fame portion 150. Additionally, vertical movable member 176 is guided by rail portions 224 of vertical fixed member 174. Rail portions 224 retain movable member 176 in channels. Alternatively, rail portions 224 are provided on movable member 176 and receive fixed member 174 in the channels created by rail portions 224.

In the extended and open position, upward end 220 of moveable member 176 is positioned proximate upward end 222 of vertical fixed member 174. In the exemplary embodiment, vertical slide 170 includes a stop (not shown) to limit how far movable member 176 can move with respect to fixed member 174. As such, door 102 can not be lifted completely out of door lift sub-assembly 156. In the extended position, door 102 is lifted to a position wherein cavity 114 is accessible and access to cavity 114 is generally unobstructed.

In an alternative embodiment, door 102 is moveable in a substantially arcuate path as door 102 is opened and closed. For example, door 102 may include both a horizontal and a vertical component as door is opened from the closed position. As such, both of slides 170 and 172 are operated simultaneously. Front frame portion 150 may include an arcuately shaped ledge, similar to ledge 216, for guiding door 102 along the predetermined path of travel as door 102 is opened. In another alternative embodiment, door 102 is movable from the extended and closed position in a generally downward direction to the open position.

Figure 8:
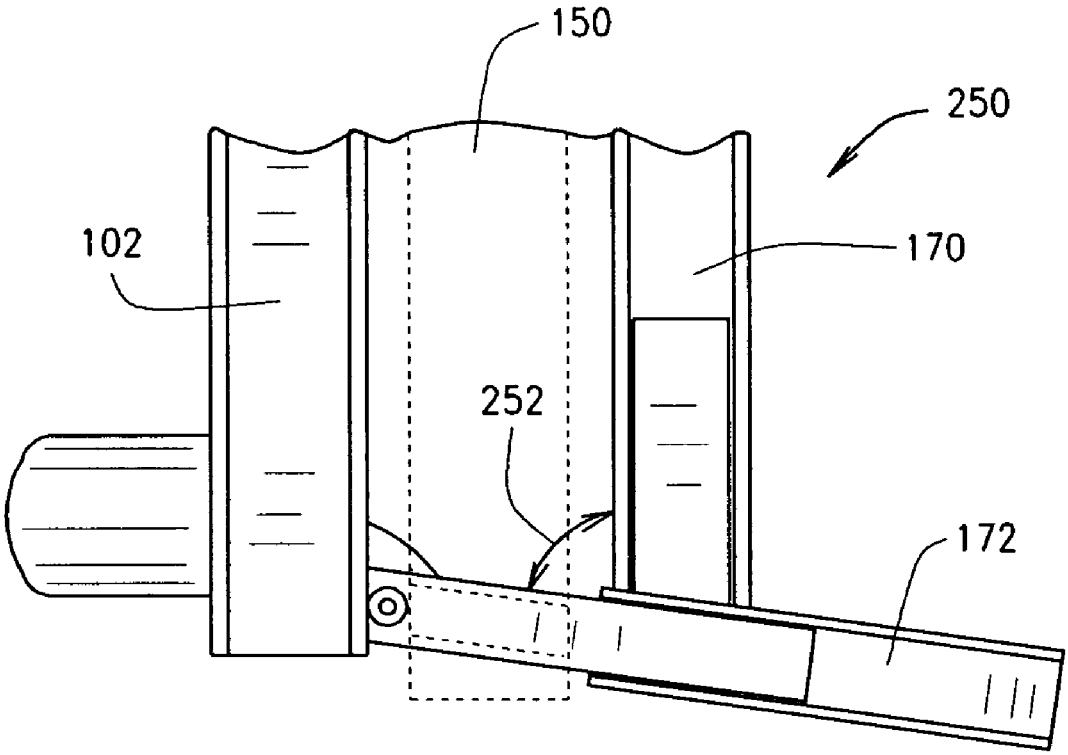
FIG. 8 illustrates an alternative door assembly for the appliance shown in FIGS. 1 and 2.

FIG. 8 illustrates an alternative door assembly 250. Door assembly 250 is similar to door assembly 154 and like components are identified with like reference numerals. In contrast to door assembly 154, horizontal slide 172 of door assembly 250 is oriented in a non-orthogonal orientation with respect to vertical slide 170. In the illustrated embodiment, vertical slide 170 is mounted substantially vertically within oven 100 (shown in FIG. 1) and horizontal slide 172 is inclined at a predetermined angle 252 from a perpendicular orientation of vertical slide 170. Horizontal slide 172 is partially upwardly sloped such that door 102 is lifted slightly from the retracted position to the extended position. In alternative embodiments, horizontal slide 172 is partially downwardly sloped or vertical slide 170 is angled from a vertical orientation. In one embodiment, angling of horizontal slide 172 facilitates reducing or correcting roll, pitch and/or yaw of door 102 with respect to front frame portion 150.

Figure 9:
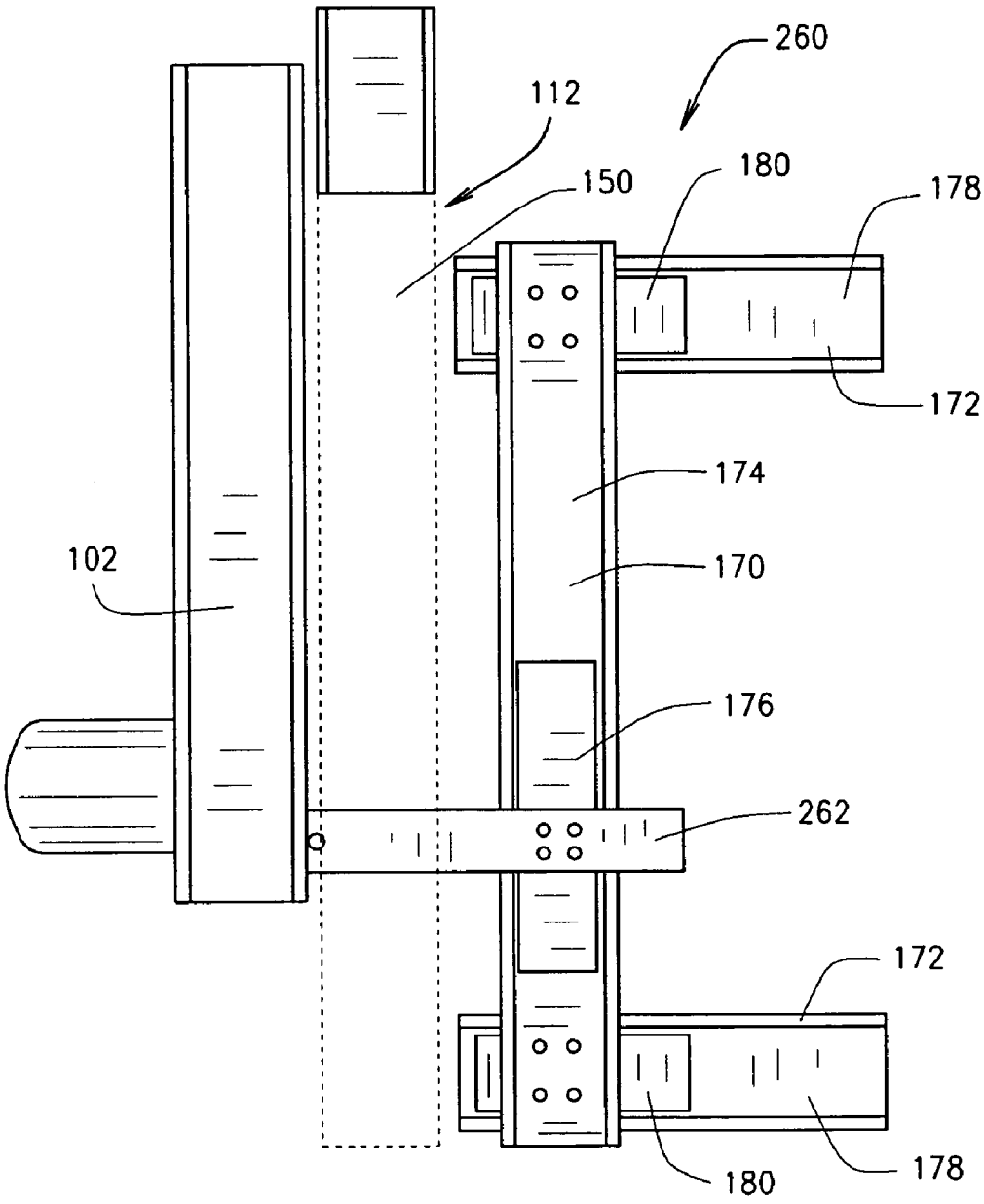
FIG. 9 illustrates another alternative door assembly for the appliance shown in FIGS. 1 and 2.

FIG. 9 illustrates another alternative door assembly 260. Door assembly 260 is similar to door assembly 154 and like components are identified with like reference numerals. In contrast to door assembly 154, door assembly 260 includes multiple horizontal slides 172. Multiple horizontal slides 172 provide stability to door 102 and facilitates reducing or correcting roll, pitch and/or yaw of door 102 with respect to front frame portion 150.

Fixed members 178 of horizontal slides 172 are mounted to chassis 112. Fixed member 174 of vertical slide 170 is coupled to movable members 180 of horizontal slides 172. A connecting member 262 is coupled to movable member 176 of vertical slide 170, and door 102 is coupled to connecting member 262. During operation, door 102 is pulled outward from the retracted position. As door 102 is moved outward, vertical slide 170 is moved generally toward front frame portion 150. Once in the extended position, door 102 is moved vertically upward from the closed position to the open position. As door 102 is moved vertically, vertical slide movable member 176 is moved vertically upward along vertical slide fixed member 174.

Figure 10:
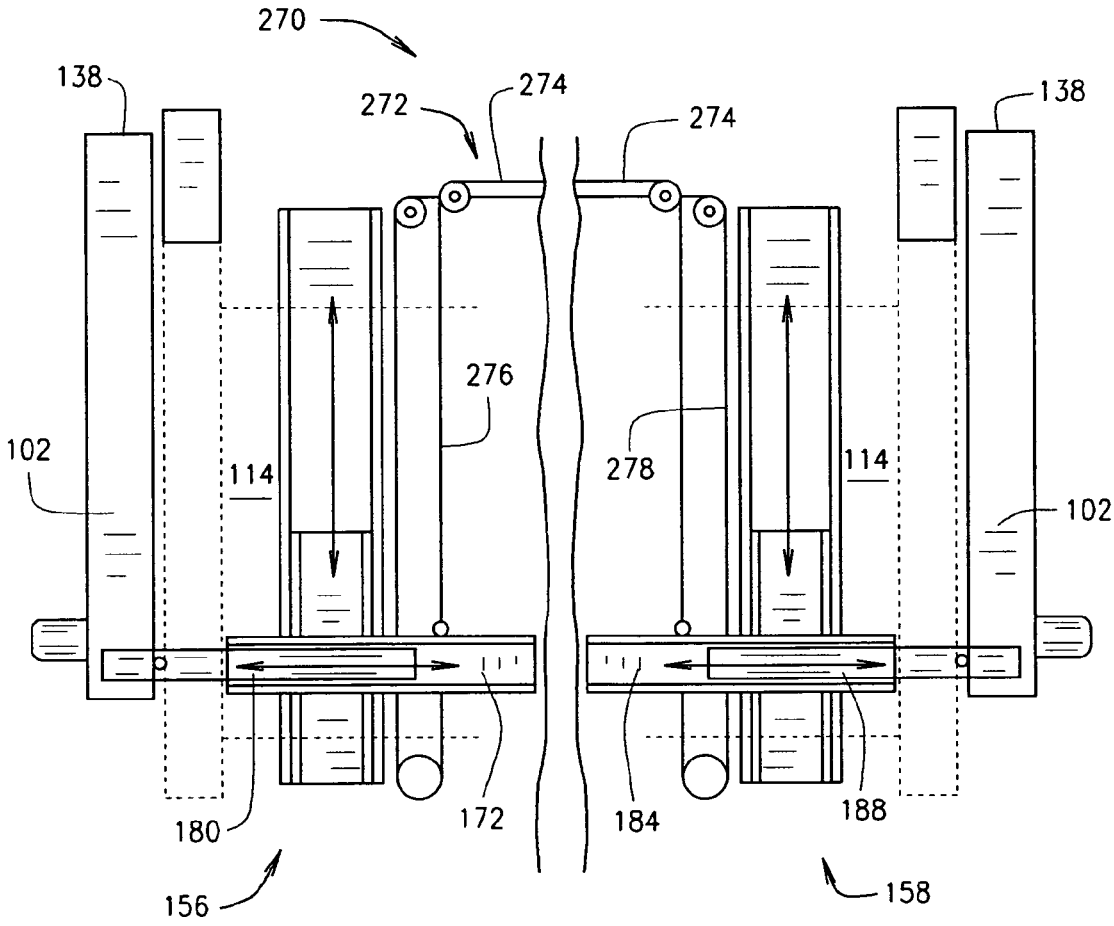
FIG. 10 illustrates a further alternative door assembly for the appliance shown in FIGS. 1 and 2.

FIG. 10 illustrates a further alternative door assembly 270, showing side views of each of first and second door lift sub-assemblies 156 and 158 and a pulley system 272 extending therebetween. Door assembly 270 is similar to door assembly 154 and like components are identified with like reference numerals. In contrast to door assembly 154, door assembly 270 includes pulley system 272. Pulley system 272 includes a continuous rope or cable 274 extending between a first side 276 and a second side 278. Cable 274 is joined to first horizontal slide 172 and second horizontal slide 184 to aide in moving first horizontal slide 172 and second horizontal slide 184 along first vertical slide 170 and second vertical slide 182, respectively. Cable 274 is joined such that each of horizontal slides 172 and 184 are movable simultaneously either upward or downward, depending on if door 102 is opening or closing.

In the exemplary embodiment, door 102 is rotatably coupled to horizontal slide movable members 180 and 188. As such, top 138 of door 102 may be rotated generally away from cavity 114 for cleaning door 102. In an alternative embodiment, door 102 is removably coupled to horizontal slide movable members 180 and 188. As such, door 102 may be removed for cleaning door 102.

A door assembly for an appliance is thus provided in a cost effective and reliable manner. The door assembly includes horizontal slides and vertical slides. An appliance door is coupled to the slides such that the door may be opened by pulling the door away from a cavity of the appliance, and then lifting the door to an open position. By providing a vertical lift door, the door may be opened in a different manner than a hinged door typically used with appliances. The vertical lift door needs less clearance to open the door, than other types of doors.

While the invention has been described in terms of various specific embodiments, those skilled in the art will recognize that the invention can be practiced with modification within the spirit and scope of the claims.

What is claimed is:

1. An appliance comprising:

a chassis defining a cavity and having an opening for accessing said cavity;

a door assembly joined to said chassis, said door assembly comprising a door for closing access to said opening, said door assembly further comprising a door lift sub-assembly comprising a horizontal slide and a vertical slide, said door coupled to one of said horizontal slide and said vertical slide, said horizontal slide moveable between a recessed position and an extended position and configured to move said door in a substantially horizontal direction, said vertical slide moveable between a closed position and an open position and configured to move said door in a substantially vertical direction, said vertical slide comprising a vertical fixed member coupled to said chassis and a vertical movable member slidably coupled to said vertical fixed member, said horizontal slide comprising a horizontal fixed member coupled to said vertical movable member and a horizontal movable member slidably coupled to said horizontal fixed member and to said door.

2. An appliance in accordance with claim 1 wherein said vertical slide and said horizontal slide are joined to a first side of said chassis, and wherein said door lift sub-assembly further comprises a second vertical slide and a second horizontal slide joined to a second side of said chassis, each of said vertical slide, said second vertical slide, said horizontal slide, and said second horizontal slide cooperating to move said door.

3. An appliance in accordance with claim 1 wherein said door has a substantially vertical orientation with respect to said chassis.

4. An appliance in accordance with claim 2 further comprising a front frame facing said opening, said door closing a portion of said front frame when said horizontal slides are in the retracted position and when said vertical slides are in the closed position, said front frame comprising a pair of vertically extending slots, said horizontal slide and said second horizontal slide configured to extend through respective slots and said horizontal slide and said second horizontal slide moveable within respective slots.

5. An appliance in accordance with claim 1 wherein said door assembly further comprises an interlock to fix a relative position of said horizontal slide with respect to said vertical slide.

6. An appliance in accordance with claim 1 wherein said door assembly further comprises a counter balance member coupled to one of said horizontal slide and said vertical slide to provide a lifting force on said horizontal slide.

7. An appliance in accordance with claim 1 wherein said vertical slide and said horizontal slide are joined to a first side of said chassis, and wherein said door lift sub-assembly further comprises a second vertical slide and a second horizontal slide joined to a second side of said chassis, and wherein said door assembly further comprises a pulley system coupled to each of said horizontal slide and said second horizontal slide and said pulley system operating such that each of said vertical slide and said second vertical slide operate simultaneously.

8. An appliance in accordance with claim 1 wherein said door assembly further comprises a motor operatively coupled to at least one of said vertical slide and said horizontal slide for driving said door lift sub-assembly.

9. An appliance comprising:

a chassis defining a cavity and having an opening for accessing said cavity;

a door assembly joined to said chassis, said door assembly comprising a door for closing access to said opening, said door having a top end and a bottom end, said door assembly further comprising a door lift sub-assembly coupled to said door proximate said bottom end, said door lift sub-assembly configured to move said door in a substantially vertical direction, said door lift sub-assembly comprising a vertical slide having a vertical fixed member coupled to said chassis and a vertical movable member slidably coupled to said vertical fixed member, said door lift sub- assembly further comprising a horizontal slide having a horizontal fixed member coupled to said vertical movable member and a horizontal movable member slidably coupled to said horizontal fixed member and to said door.

10. A door assembly for an appliance, said door assembly comprising:

a door for the appliance;

a vertical slide comprising a vertical fixed member coupled to the appliance and a vertical movable member slidably coupled to said vertical fixed member; and a horizontal slide comprising a horizontal fixed member coupled to said vertical movable member and a horizontal movable member slidably coupled to said horizontal fixed member and to said door, wherein said horizontal slide is configured to move said door in a substantially horizontal direction and wherein said vertical slide is configured to move said door in a substantially vertical direction.

11. A door assembly in accordance with claim 10 wherein said vertical slide and said horizontal slide are configured to be joined to a first side of the appliance, and wherein said door assembly further comprises a second vertical slide and a second horizontal slide configured to be joined to a second side of the appliance, each of said vertical slide, said second vertical slide, said horizontal slide, and said second horizontal slide cooperating to move said door.

12. A door assembly in accordance with claim 10 wherein said door has a substantially vertical orientation with respect to the appliance.

13. A door assembly in accordance with claim 11 wherein the appliance includes a front frame having a pair of vertically extending slots, said door configured to close a portion of the front frame when said horizontal slides are in the retracted position and when said vertical slides are in the closed position, said horizontal slide and said second horizontal slide configured to extend through respective slots and said horizontal slide and said second horizontal slide elide, moveable within respective slots.

14. A door assembly in accordance with claim 10 further comprising an interlock to fix a relative position of said horizontal slide with respect to said vertical slide.

15. A door assembly in accordance with claim 10 further comprising a counter balance member coupled to said horizontal slide provide a lifting force on said horizontal slide.

16. A door assembly in accordance with claim 10, wherein said vertical slide and said horizontal slide are configured to be joined to a first side of the appliance, and wherein said door assembly further comprises:

a second vertical slide and a second horizontal slide configured to be joined to a second side of the appliance; and a pulley system coupled to each of said horizontal slide and said second horizontal slide, said pulley system operating such that each of said first vertical slide and said second vertical slide operate simultaneously.

17. A door assembly in accordance with claim 10 further comprising a motor operatively coupled to at least one of said vertical slide and said horizontal slide for driving said door lift sub-assembly.

* * * * *